United States Patent [19]

Pitts

[11] Patent Number: 4,781,485

[45] Date of Patent: Nov. 1, 1988

[54] CONTINUOUS RING LOOSE LEAF NOTEBOOK

[75] Inventor: Warren R. Pitts, Needham, Mass.

[73] Assignee: Dennison Manufacturing Company, Framingham, Mass.

[21] Appl. No.: 55,405

[22] Filed: May 29, 1987

[51] Int. Cl.[4] ..... B42F 13/20

[52] U.S. Cl. ..... 402/45; 402/46

[58] Field of Search ..... 402/45, 46, 47, 48, 402/50, 52, 54, 56

[56] References Cited

U.S. PATENT DOCUMENTS

| | | | |
|---|---|---|---|
| 1,396,631 | 11/1921 | Jackson | 402/45 |
| 2,878,816 | 3/1959 | Panfil | 402/45 |
| 4,264,228 | 4/1981 | Staats | 402/45 X |

*Primary Examiner*—Paul A. Bell

*Attorney, Agent, or Firm*—George E. Kersey

[57] ABSTRACT

Loose leaf retention mechanism, having a ring position shift mechanism, an elongated housing for containing the shift mechanism, coupling means for coupling first terminal portions of one or more continuous unitary (non-split) rings to the shift mechanism, and actuation means, coupled to the shift mechanism, for causing the shift mechanism to selectively assume a first position wherein second terminal portions of the continuous rings, widely separated from the first terminal portions, are positioned within the housing, or a second position wherein second terminal portions of the rings are separated from the housing to enable punched loose leaf sheets to be coupled to the rings.

5 Claims, 1 Drawing Sheet

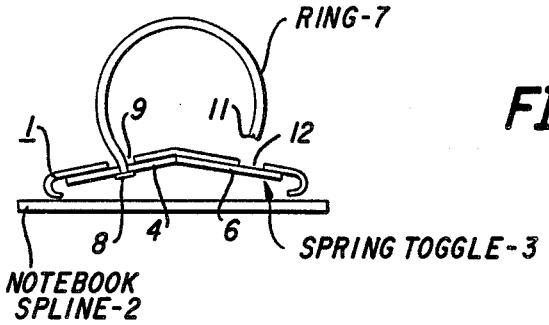
FIG. 1
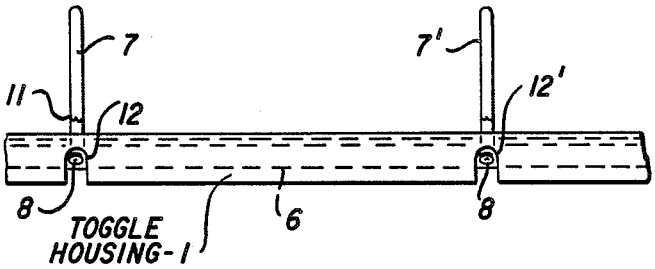
FIG. 2
FIG. 3
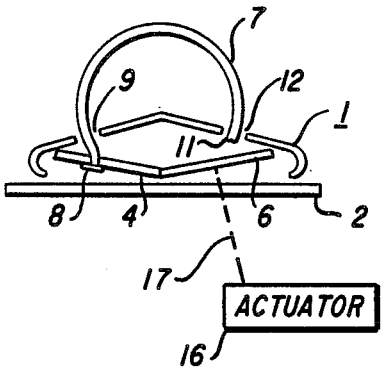

CONTINUOUS RING LOOSE LEAF NOTEBOOK

BACKGROUND OF THE INVENTION

The present invention relates to the field of loose leaf notebooks.

The familiar two or three split ring loose leaf notebook has a spring toggle mechanism within an elongated housing, together with toggle actuation members which cause the split rings to open, to enable the user to slip punched hole sheets within the notebook. The split rings are thereafter closed, whereby terminal portions of the rings normally abut each other to form a closed ring for securing the punched hole sheets. Upon frequently opening and closing of the rings to insert and remove the punched sheets, the terminal portions of the rings, which upon manufacture abut each other, often become laterally misaligned, which in turn produces tearing of the paper at the punched holes. This undesirable effect normally calls for the use of the familiar circular reinforcement stickers, which are applied about the peripheral areas of the punched holes. Furthermore, lateral misalignment of the split rings looks sloppy.

Thus, it is the principal object of the present invention to provide a novel loose leaf notebook paper retention mechanism which eliminates the aforesaid split rings.

SUMMARY OF THE INVENTION

In accordance with a preferred embodiment, a loose leaf paper retention mechanism is provided, having a ring position shift mechanism, an elongated housing for containing the shift mechanism, coupling means for coupling first terminal portions of one or more continuous unitary rings to the shift mechanism, and actuation means, coupled to the shift mechanism, for causing the shift mechanism to selectively assume a first position wherein second terminal portions of said rings, widely separated from said first terminal portions, are positioned within the housing, or a second position wherein second terminal portions of the rings are separated from the housing to enable punched loose leaf sheets to be coupled to the rings.

Other objects, features and advantages of the invention will become apparent upon study of the following detailed description, taken in conjunction with the drawings in which:

FIGS. 1 and 2 illustrate the paper retention mechanism in the open position and FIG. 3 illustrates the paper retention mechanism in the closed position.

DETAILED DESCRIPTION

As shown in FIGS. 1 and 2, an elongated toggle housing 1 is mounted upon notebook spline 2 in a manner well known in the art. Conventional toggle mechanism 3 comprises elongated toggle members 4 and 6 which abut each other within the central housing portion. A first terminal portion 9 of ring 7 is affixed to a first toggle member 4 by means of a weld or rivet 8, and passes through an opening 9 in housing 1. Ring 7 has a second terminal portion 11 which is separated from orifice 12 of housing 1 by a short distance to enable punched hole sheets to be passed about ring 7. The punched hole sheets are thereafter secured by causing toggle mechanism 3 to assume a second state whereby terminal portion 11 of ring 7 is passed through orifice 12 and is positioned within housing 1 as illustrated in FIG. 3. Actuator 16 is schematically indicated as mechanically coupled to toggle mechanism 3 via a dashed line 17. The actuator is the familiar manually operated lever pair which causes the conventional toggle 3 to snap downwardly from an upper position indicated in FIG. 1 to a lower position indicated in FIG. 3. Since toggle member 4 is moved to a lower position, it may be seen that terminal portion 11 of ring 7 is pulled through orifice 12 of the housing. Details of actuator 16 and linkage 17 have not been illustrated, since they are well known to workers in the art, as they form a portion of the conventional widely utilized loose leaf ring binder notebooks. Since ring 7 is substantially continuous throughout its length, it may be seen that the aforesaid problems relating to lateral displacement of the terminal abuting portions of segmented rings have been avoided.

Ring 7' is also coupled to the elongated spring toggle member 4 as shown in FIG. 2. While the aforesaid embodiment is preferred, other variations may be made within the scope of the invention which is to be limited only by the terms of the following claims and art recognized equivalents thereof. For example, the rings themselves may function as the shift mechanism actuation means, whereby the user pulls and pushes the ring(s) to actuate the shift mechanism.

What is claimed is:

1. A toggle member sheet retainer comprising: an elongated housing: a plurality of toggle members contained within said housing; at least one continuous unitary sheet retainer ring member having first and second terminal portions; means for coupling a first terminal portion of said ring member to one of said toggle members; at least one pair of spaced openings in said housing, said toggle members, said at least one ring member, and said openings being arranged so that a portion of said ring member near said first terminal portion passes through one of said openings and the second terminal portion of said ring member is aligned with the second opening in said pair; means for causing said sheet retainer to selectively assume a first or second position; said first position having the second terminal portion of said ring member passing through said second opening and within said housing, and said second position having said second terminal portion spaced from said second opening and said housing to enable sheets to be coupled to said ring member.

2. A sheet retainer as defined in claim 1 wherein said toggle members abut each other at a central portion of said housing.

3. A sheet retainer as defined in claim 1 wherein said coupling means is a weld.

4. A sheet retainer as defined in claim 1 wherein said ring member is affixed to said one toggle member by rivet means.

5. A sheet retainer as defined in claim 1 wherein the means for causing said sheet retainer to assume a selected position is a manually operated lever.

* * * * *